US005333999A

United States Patent [19]

Sakakura et al.

[11] Patent Number: 5,333,999

[45] Date of Patent: Aug. 2, 1994

[54] VARIABLE DISPLACEMENT COMPRESSOR

[75] Inventors: Daisuke Sakakura, Anjo; Hiroshi Okazaki, Kariya, both of Japan

[73] Assignee: Aisin Seiki Kabushiki Kaisha, Kariya, Japan

[21] Appl. No.: 30,713

[22] Filed: Mar. 12, 1993

[30] Foreign Application Priority Data

Mar. 12, 1992 [JP] Japan ..... 4-053808

[51] Int. Cl.[5] ..... F04B 49/02

[52] U.S. Cl. ..... 417/309

[58] Field of Search ..... 417/309, 310

[56] References Cited

U.S. PATENT DOCUMENTS 2,683,418 7/1954 Smith ..... 417/309
3,224,662 12/1965 Oldberg ..... 417/309 X
4,557,670 12/1985 Inagaki et al. ..... 417/309 X
4,904,164 2/1990 Mabe et al. ..... 417/309 X

FOREIGN PATENT DOCUMENTS 159582 12/1981 Japan ..... 417/309
63-134895 6/1988 Japan .

*Primary Examiner*—Richard E. Gluck
*Attorney, Agent, or Firm*—Burns, Doane, Swecker & Mathis

[57] ABSTRACT

A variable displacement compressor includes a housing having therein a space, a rotor eccentrically disposed in the space of the housing so as to define a compression chamber and an intake chamber in the housing, a bypass passage formed in the housing for establishing fluid communication between the compression chamber and the intake chamber and being in the form of a slot, and a device for opening and closing the bypass passage which is movable depending on a pressure in the intake chamber in a direction perpendicular to the bypass passage.

2 Claims, 4 Drawing Sheets

VARIABLE DISPLACEMENT COMPRESSOR

BACKGROUND OF THE INVENTION

The present invention is directed to a variable displacement compressor, and in particular to a variable displacement compressor for use in an on-vehicle air conditioner system.

A conventional variable displacement compressor is disclosed in Japanese Patent Laid-open Print No. 63(1988)-134895. In the conventional variable displacement compressor, in order to vary the discharging capacity in accordance with the required cooling ability, a bypass valve is disposed in a bypass passage for opening and closing the bypass passage. The bypass passage is formed so as to establish fluid communication between a compression chamber and an intake chamber. At one end of the bypass valve, there is provided a control chamber into which pressure is supplied. The other end of the bypass valve is continually urged toward the control chamber by a spring. Thus, a differential pressure across the bypass valve is set to be adjusted for the opening and the closure thereof.

However, the foregoing structure results in a device that is complex in construction and large in size.

SUMMARY OF THE INVENTION

It is, therefore, a principal object of the present invention to provide a variable displacement compressor without the foregoing drawbacks.

It is another object of the present invention to provide a variable displacement compressor which possesses quick responsiveness.

In order to attain the foregoing objects, a variable displacement compressor is comprised of a housing having therein a space, a rotor eccentrically disposed in the space of the housing so as to define a compression chamber and an intake chamber in the housing, a bypass passage formed in the housing for establishing fluid communication between the compression chamber and the intake chamber and being in the form of a slot, and a device for opening and closing the bypass passage which is movable depending on a pressure in the intake chamber in a direction perpendicular to the bypass passage.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF A PREFERRED EMBODIMENT

Figure 1:
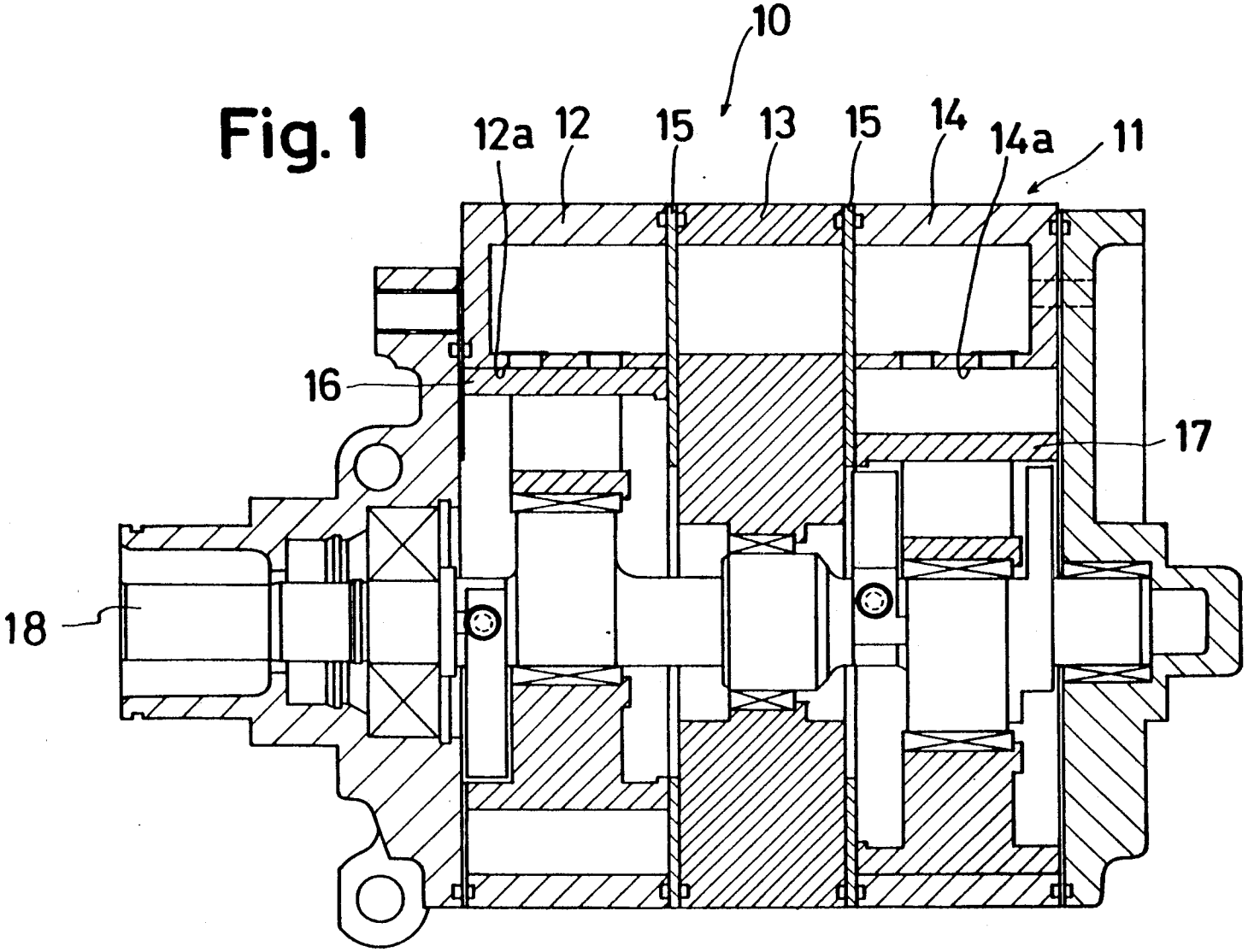
FIG. 1 is a cross-sectional view of a variable displacement compressor in accordance with the present invention.
Figure 2:
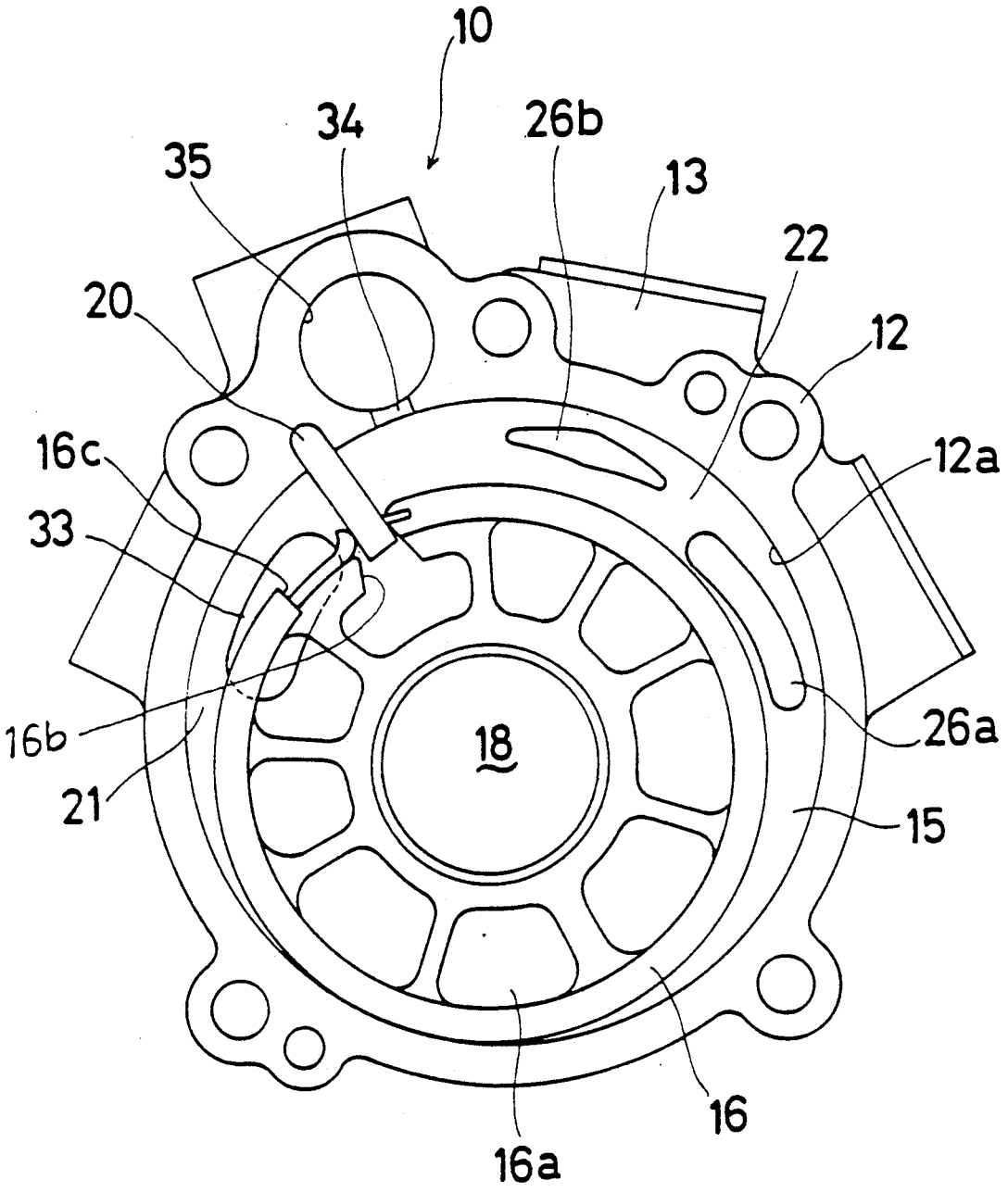
FIG. 2 is a view for showing an inside structure of a variable displacement compressor in accordance with the present invention.
Figure 3:
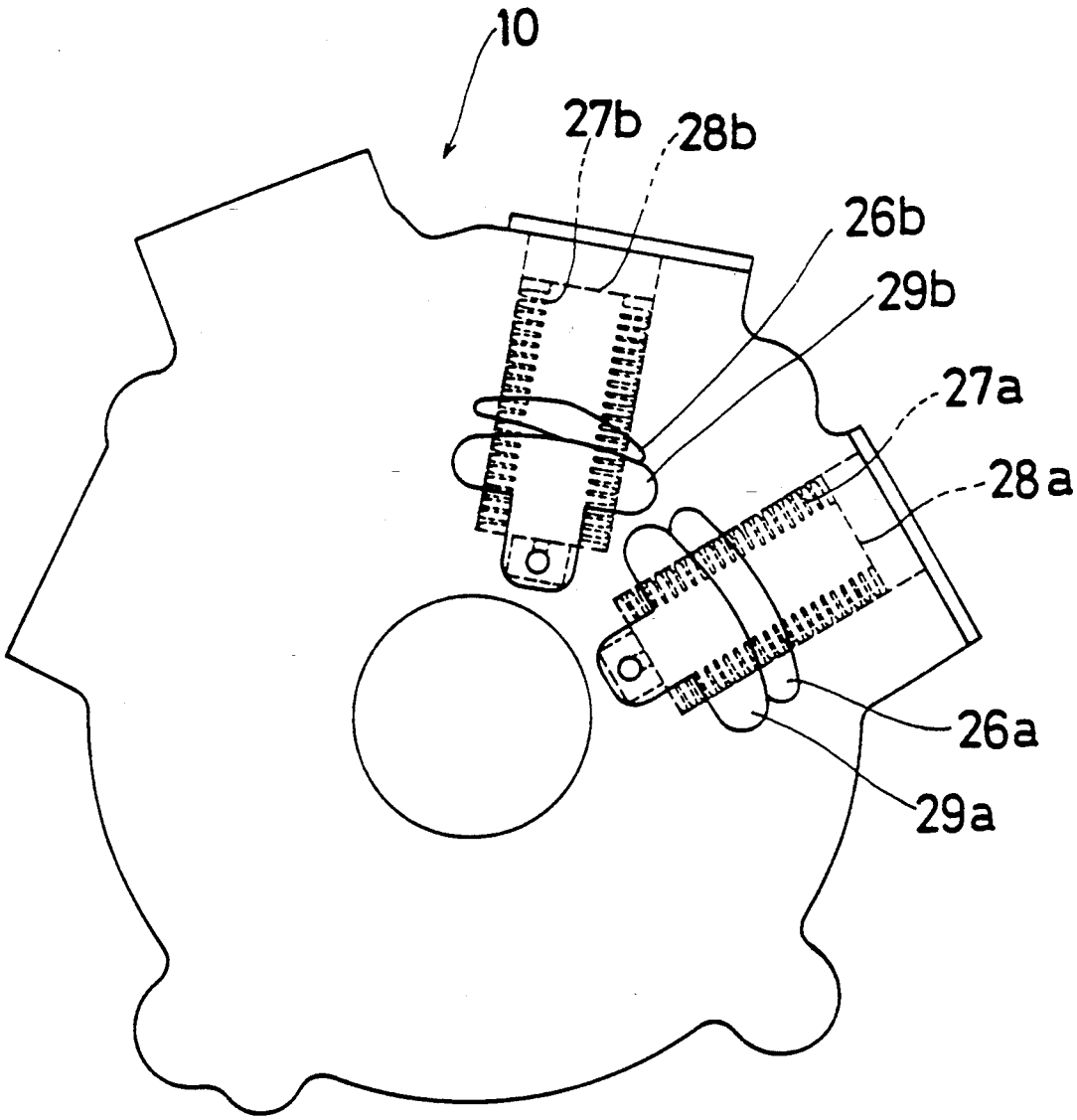
FIG. 3 is a view showing how a means for opening and closing a bypass passage is arranged.

A preferred embodiment of the present invention will be described hereinunder in detail with reference to the accompanying drawings.

Referring to FIGS. 1 through 4, a variable displacement compressor 10 includes a housing 11 which is comprised of a front portion 12, a center portion 13, and a rear portion 14. Between the front portion 12 and the center portion 13, there is disposed a plate 15. In addition, between the rear portion 14 and the center portion 13, there is disposed another plate 15.

In the housing 11, there are formed cylinder spaces **12*a* and 14*a* at the sides of the front portion 12 and the rear portion 14, respectively. In the cylinder space 12*a* (14*a*), there is disposed a rotor 16 (17) which is eccentrically mounted on a shaft 18 so as to revolve. A 180-degree phase difference is set between rotations of the rotors 16 and 17**.

The center portion 13 is provided with a separator 20 in the form of a flat plate. The separator 20 extends into the space **12*a* so that a portion between an inner surface of the space 12*a* and an outer surface of the rotor 16 is divided into an intake chamber 21 and a compression chamber 22. The intake chamber 21 is set to draw fluid through an aperture 33. The compression chamber compresses the fluid at a pressure, and the resulting fluid is discharged to a discharging space 35 via an aperture 34. It is to be noted that the separator 20 prevents rotation of the rotor 16. Moreover, the intake chamber 21 is in fluid communication with an inner portion 16*a* of the rotor 16 via a stepped portion 16*c* formed at a groove 16*b* of the rotor 16 as well-known at a side of the intake chamber 21**.

A bypass passage **26*a* which is in the form of an arc-shaped slot is provided in the plate 15 and the center portion 13, and is arranged along the circumferential direction of the rotor 16. The bypass passage 26*a* is perpendicular to an expansion direction of a bellows 28*a* or a moving direction of a valve 29*a***.

A bypass passage **26*b*which is in the form of a shallow triangle is provided in the plate 15 and the center portion 13, and is arranged along the circumferential direction of the rotor 16. The open area of the bypass passage 26*b*becomes smaller toward its end portion. The bypass passage 26*b*is designed to prevent fluid communication thereof with each inner portion 16*a* of the rotor 16 which leads to an entrance of the discharged pressure into the intake chamber 21 through each inner portion 16*a***.

Figure 4:
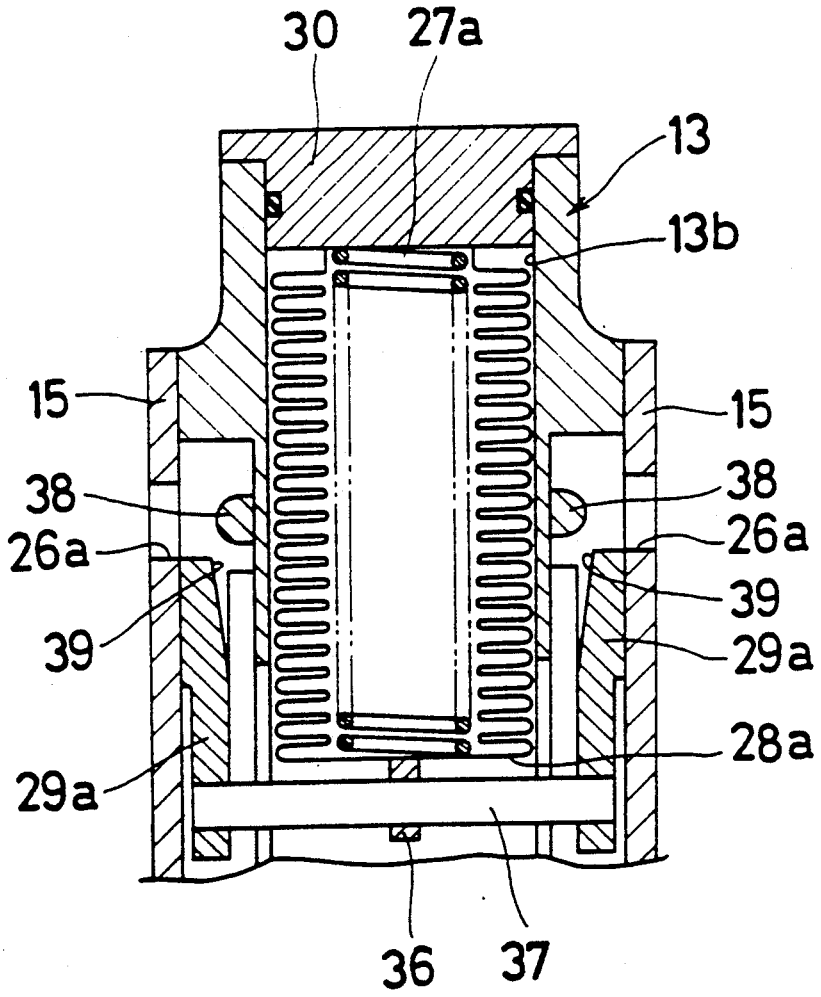
FIG. 4 is a cross-sectional view of a means for opening and closing a bypass passage.

Referring to FIG. 4, the bellows **28*a* is accommodated within a control chamber 13*b* which is formed in the center portion 13. Opposite ends of the bellows 28*a* are fluid-tightly closed. Within the bellows 28*a*, there is mounted a coil spring 27*a*. At the central portion of the space 12*a*, the control chamber 13*b* is in fluid communication with the intake chamber 21 by way of the inner portion 16*a* and a stepped portion 16*c*. A fluid-tight sealing is established at an opening of the control chamber 13*b* by a plug 30. The spring constant of the coil spring 27*a*is determined in light of an axial deformation of the bellows 28*a* when the intake pressure in the control chamber 13*b* is at a value. Thus, the spring constant of the bellows 28*a* per se depends on the rigidity or stiffness of the bellows 28*a* per se, the number of folds in the bellows 28*a*, the entire configuration of the bellows 28*a*, and the coil spring 27*a*. The lower side of the bellows 28***a* is secured with a first guide pin 36 which extends outwardly in the axial direction of the bellows 28*a*. The first guide pin 36 is connected to a second guide pin 37 which extends perpendicularly to the first guide pin 36. The second guide pin 37 is connected to a valve 29*a*which slides on the plates 15 with the aid of a guide means (not shown). Thus, in accordance with an expansion or a shrinkage of the bellows 28*a*, the valve 29*a*is set to be moved in the vertical direction, thereby closing or opening the bypass passage 26*a*. Furthermore, an inner surface of the valve 29*a*is formed at its upper side with a tapered portion 39 which is set to be brought into engagement with a pair of stoppers 38. The tapered portion 39 is designed to establish a gradual decrease of a distance between the tapered portion 39 and the stopper 38 during the closing movement of the valve 29*a*. Thus, when the valve 29*a*closes the bypass passage 26*a*, a fluid-tight separation occurs between the intake chamber 21 and the compression chamber 22. In addition, an angle which the tapered portion 39 makes with respect to the moving direction of the valve 29 is determined on the basis of that a downward component of the force which is exerted from the stopper 38 to the valve 29*a*fails to exceed a force for expanding or shrinking the bellows 28*a* and a sufficient fluid-tight ability of the valve 29*a*relative to the bypass passage 26*a*.

A bellows 28*b* is designed to be identical with the bellows 28*a* except that the spring constant of the former is larger than that of the latter. Thus, a detailed description of the bellows 28*b* is omitted.

In operation, when a rotational force is transmitted from an engine (not shown) of a vehicle (not shown) to the rotor 16, the rotor 16 is brought into its revolution while being prevented from rotating by the separator 20. As a result of the revolution, the compression chamber 22 repeatedly increases and decreases in volume. During the intake process which is established while the compression chamber 22 is being increased in volume, a low temperature and low pressure gas is sucked into the compression chamber 22.

In the next step, when the pressure of the resulting gas exceeds a value as a result of the volume decrease of the compression chamber 22, the gas is brought into discharge into the discharge chamber 35 through the discharging passage 34.

It is to be noted that the discharging ability of the variable displacement compressor 10 depends on the condition of the cooling cycle of the on-vehicle air conditioner system. If the discharging ability is in excess, the cooling ability of an evaporator (not shown) is excessive. The result is a pressure decrease of the gas that is sucked into the variable displacement compressor 10. That is to say, under the excess discharging ability of the variable displacement compressor 10, the pressure in the intake chamber 21 is also decreased. The pressure in the intake chamber 21 is set to be introduced into the control chamber 13*b* via the stepped portion 16*c*, the inner portion 16*a*, and the control chamber 13*b*, and when the pressure in the control chamber 13*b* becomes below a value, the bellows 28*a* is expanded. The resultant expansion of the bellows 28*a* causes the valve 29*a*to open the bypass passage 26*a* so that the gas in the compression chamber 22 is again released to the intake chamber 21 via the inner portion 16*a*, and the stepped portion 16*c*: until the rotor 16 entirely closes the bypass passage 26*a*. Under this resultant condition, the bellows 28*a* is not in expansion, and the bypass passage 26*b*remains closed.

Moreover, when the discharging ability of the variable displacement compressor 20 ia in excess, the pressure intake chamber 21 is also lowered. When the second control chamber (not shown) is supplied with the pressure from the intake chamber 21 via the stepped portion 16*b* and the inner portion 16*b*, the bellows 28*b* is brought into expansion, which results in the valve 29*b* that is connected to the bellows 28*b* beginning to open the bypass passage 26*a*. Then, the gas in the compression chamber 22 is released into the intake chamber 21 via the control chamber 12*a*, the inner portion 16*a*, and the stepped portion 16*c* until the bypass passage 26*b*is closed entirely by the rotor 16.

In addition, in the present invention, when the rotor 16 closes the bypass passages 26*a* and 26*b*, the rotor 16 makes an angle of 90 degrees with respect to the lengthwise direction of each of the bypass passages 26*a* and 26*b*, which enables an easy adjustment of the volume in the space 12*a*.

As detailed above, the present invention has the following practical advantages or merits.

The means for opening and closing the bypass passage is deformed depending on the intake pressure, and the bypass passage is formed as a slot which is perpendicular to the moving direction of the opening and closing means. The result is a decrease in the moving distance of the opening and closing means when it opens or closes the bypass passage. Also, since the bypass passage is in the form of a slot, an opening area of the bypass passage can be increased without enlarging the volume of the compressor per se, and its performance can be maintained even when the engine rotates at high speeds. The shorter moving distance of the means for opening and closing the bypass passage will ensure a quick responsiveness of the device. Moreover, the tapered portion of the valve which is urged in the direction of its closure is set to be brought into engagement with the stopper. As a result, a high sealing ability can be established which prevents the leakage of gas from being discharged toward the intake chamber. Furthermore, the coil spring being under a sealed condition within the bellows permits the movement of the bellows which is free from an ambient temperature.

The invention has thus been shown and described with reference to a specific embodiment. However, it should be noted that the invention is in no way limited to the details of the illustrated structures, but changes and modifications may be made without departing from the scope of the appended claims.

What is claimed is:

1. A variable displacement compressor comprising:

a housing in which is defined a space;

a rotor eccentrically disposed in the space of the housing to define a compressor chamber and an intake chamber in the housing, said rotor including an outer side;

a bypass passage formed in the housing for establishing fluid communication between the compression chamber and the intake chamber, the bypass passage being an arc-shaped slot that is arranged along a circumferential direction of the rotor at the outer side; and means for opening and closing the bypass passage, the means for opening and closing being positioned adjacent the bypass passage and being movable in a radial direction relative to the bypass passage depending on the pressure in the intake chamber, the opening and closing means including a bellows, a spring accommodated within the bellows, and a valve for being moved in unison with the bellows and the spring when the pressure in the intake chamber reaches a set value, the valve including a tapered portion which is brought into engagement with a projecting element of the housing during movement of the valve to establish a fluid tight engagement between the valve and an outer periphery of the bypass passage

2. A variable displacement compressor in accordance with claim 1, wherein said bellows is connected to said valve so that movement of said bellows results in movement of said valve.

* * * * *